United States Patent [19]

Anderle

[11] 4,354,300

[45] Oct. 19, 1982

[54] HOLDER FOR SUPPORTING A VALANCE AT A VENETIAN BLIND HEAD

[75] Inventor: Joseph A. Anderle, Clifton, N.J.

[73] Assignee: Levolor Lorentzen, Inc., Hoboken, N.J.

[21] Appl. No.: 111,467

[22] Filed: Jan. 11, 1980

Related U.S. Application Data

[62] Division of Ser. No. 863,243, Dec. 22, 1977, Pat. No. 4,222,156.

[51] Int. Cl.[3] ..... A44B 21/00

[52] U.S. Cl. ..... 24/343; 160/38; 248/229

[58] Field of Search ..... 24/343, 344, 345, 369, 24/370, 377; 248/229, 441 C, 226.5, 221.4, 225.2, 222.4; 160/178 R, 178 B, 38

[56] References Cited

U.S. PATENT DOCUMENTS

| | | | |
|---|---|---|---|
| 2,053,124 | 9/1936 | Banks | 248/229 |
| 2,154,909 | 4/1939 | Lorentzen | 160/38 |
| 2,155,152 | 4/1939 | Shehan | 160/38 |
| 2,706,521 | 4/1955 | Nelson | 160/38 |
| 2,806,524 | 9/1957 | Klenz | 160/38 |
| 3,969,793 | 7/1976 | Crosby | 5/259 B |

FOREIGN PATENT DOCUMENTS

| | | | |
|---|---|---|---|
| 626705 | 9/1961 | Canada | 160/178 R |
| 1043 | of 1893 | United Kingdom | 248/225.2 |
| 1061427 | 3/1967 | United Kingdom | 24/73 B |

*Primary Examiner*—Kenneth Dorner

[57] ABSTRACT

A holder or clip for supporting a valance in front or around a venetian blind head, with a flat sheet metal body having prongs for holding the valance and having tabs or an especially shaped body portion for connection to the blind head.

1 Claim, 15 Drawing Figures

HOLDER FOR SUPPORTING A VALANCE AT A VENETIAN BLIND HEAD

This is a division of application Ser. No. 863,243, filed Dec. 22, 1977 now U.S. Pat. No. 4,222,156.

BACKGROUND OF THE INVENTION

The present invention relates to venetian blinds and more specifically to holders or clips for supporting a valance in front of or around the head of a venetian blind.

A valance for a venetian blind head is desirable in order to eliminate an objectional but unavoidable light gap at the top of the blind. Most blinds have a clearance at the top so that if the installation brackets are fastened overhead, the brackets will provide space above the head for thickness of the bracket and screw heads. If the window jamb is not deeply recessed or if there is a small frame or sash, (such as for instance in metal casement windows) a visible light gap exists. Such gap can be covered with the valance according to the present invention.

It is very difficult to finish the heads of venetian blinds with various colors, designs, and trims since this would involve a costly process and it might be difficult to match the color and design of the head channel and the slats of the venetian blind since they are coated and formed by different processes.

Still further, a window covering would look more attractive aesthetically by having the horizontal slats begin from the very top of the window opening to the bottom rather than starting below the venetian blind head.

In tilting a venetian blind to closed position, the slats have a percentage of overlap which provides better light exclusion and control. However, the top slat cannot overlap the bottom of the head. Therefore, an objectionable light gap may be produced if the blind is not closed fully or in some cases due to mechanical or assembly discrepancies, the gap will even appear when the blind is completely closed.

Finally, a valance gives the interior decorator the option of using a different color scheme for the valance than for the slats, that is to either use contrasting or matching colors or designs in a room.

Basically, the valance consists of two slats, one arranged above the other. The lower slat slightly overlaps the bottom edge of the upper slat in order to disguise any irregularities, ripples, dents or non-parallelness in the slats, especially since the valance is above eye level. Although the thickness of the clip will create a light gap, such gap will not be visible because of the overlap and sight angle.

It is an object of the present invention to provide a variety of holders for supporting a valance at various locations at a venetian blind head channel.

BRIEF DESCRIPTION OF THE DRAWINGS

The invention is illustrated by way of example in the attached drawings, in which.

DETAILED DESCRIPTION OF PREFERRED EMBODIMENTS

Figure 1:
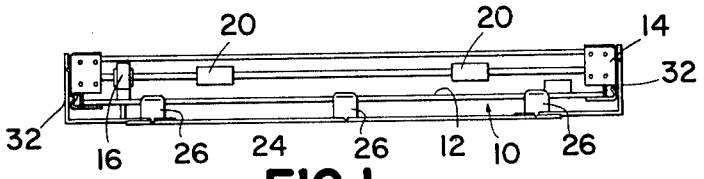
FIG. 1 is a top view of a venetian blind head with the valance according to the present invention attached.
Figure 2:
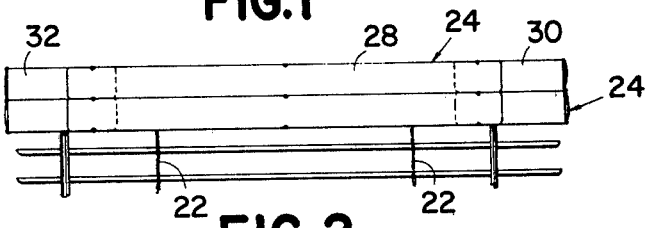
FIG. 2 is a front elevation of the venetian blind head and valance of FIG. 1.
Figure 3:
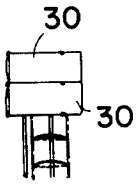
FIG. 3 is a side elevation of FIG. 2.

Referring now to the drawing in detail, and FIGS. 1 to 3 in particular, a venetian blind head generally designated with the reference numeral 10 comprises a head channel 12 with end brackets 14. The head channel contains the usual components for operating a venetian blind, such as a tilter 16 to be operated by a wand 18 (see FIG. 4) or a cord and supports 20 for the ladders 22. All of these elements described so far are conventional and do not form part of the present invention.

A valance 24 consisting for instance of two slats is attached to the head channel by clips or holders 26 (three being shown in FIG. 1). Various valance designs are contemplated and such valances are disclosed in assignee's copending U.S. Design Patent application Ser. No. 747,861, filed Dec. 6, 1976. Thus, for instance, FIG. 2 indicates that each valance 24 comprises a central section 28 overlapping two end sections 30, 32, respectively. The end sections 30,32 are held to the brackets 14 by clips or holders 60 described in detail further below.

Figure 4:
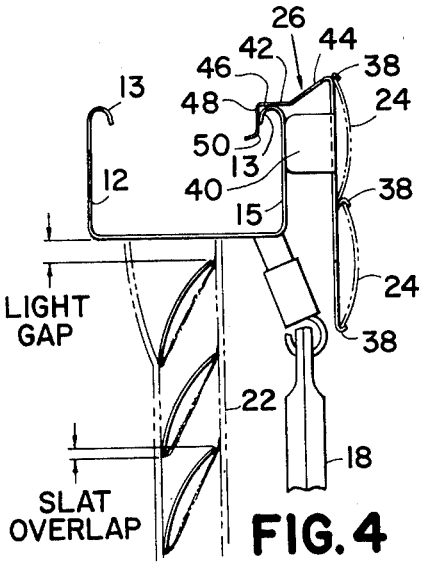
FIG. 4 is a cross section through a venetian blind head with two valances and one embodiment of a holder or clip for attaching the valance to the blind head.
Figure 5:
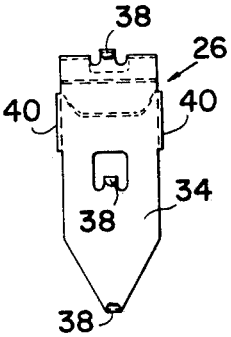
FIGS. 5 and 6 illustrate the holder or clip in front and rear elevation, respectively.
Figure 6:
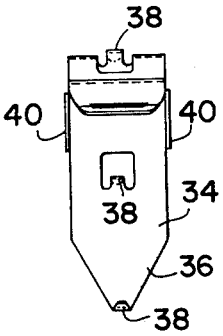

A clip or holder 26 for connecting the front valance 24 to the head channel 12 is shown in FIGS. 4 to 6. It comprises a sheet metal body 34 or substantially rectangular shape with a substantially triangular end portion 36. However, end section 36 could likewise be rectangular.

Clip 26 is also provided with three hook-like elements 38, lateral wings 40 and a rear extension 42 including a downwardly sloping portion 44, a substantially horizontal portion 46, a substantially vertical portion 48, and an indented portion 50. These portions are clearly shown in FIG. 4, which figure also illustrates how the clip 26 is attached to a head channel 12 with a downwardly and inwardly folded portion 13. The lateral wings 40 rest against the substantially vertical wall 15 of head channel 12 while section 46 rests on portion 13 and portions 48 and 50 are firmly pressed against portion 13 so that clip 26 assumes a stable position with respect to the head channel 12. Two or more of clips 26 can be arranged along the length of the head channel and valances 28 or 30 may be inserted between the hook-like elements 38, as likewise shown in FIG. 4.

While clip 26 is shown in FIGS. 4 to 6 as being made from one integral piece of sheet metal, it is to be understood that the clip could also be made from two or more sheet metal pieces if such were desired for manufacturing or other reasons. Thus, for instance, portions 34, 36 and 38 could form one piece, and portions 40 to 50 another piece, which would be connected to the piece forming portions 34, 38, for instance by welding, by connecting elements, such as screws, and in any other convenient manner.

Figure 7:
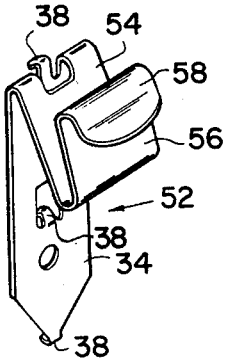
FIG. 7 is a perspective view of a second embodiment of a holder or clip for the valance.

A further embodiment of a clip is illustrated in FIG. 7. Clip 52 shown therein has a main body portion 34 which could essentially be the same as portion 34 of clip 26 with hook-like elements 38. Clip 52 also comprises a downwardly bent portion 54 and an upwardly bent portion 56 substantially parallel to portion 34, and a curved portion 58 which would be substantially the equivalent of portions 46, 48 and 50 of clip 26 (See FIG. 4) in that it fits over portion 13 of channel 12 and could be forced thereover to snap clip 52 in place onto head channel 12 with portion 56 firmly placed against side wall 15.

Figure 8:
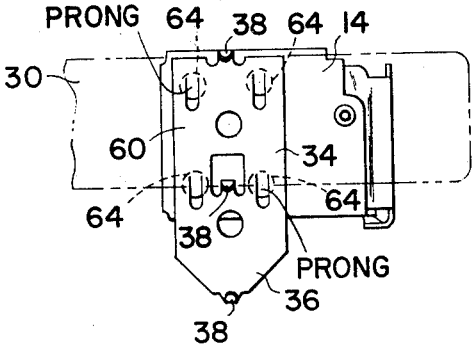
FIG. 8 illustrates a third embodiment of a holder for attaching a portion of the valance to the side of the head of a venetian blind.
Figure 9:
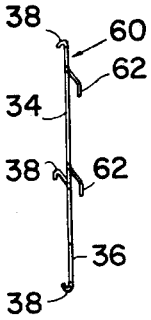
FIG. 9 is a side view of the holder of FIG. 8.

According to the present invention, a different type of clip or holder is provided for attaching valances to an end bracket, such as bracket 14 shown in FIG. 1. A first embodiment of such a clip is shown at 60 in FIGS. 8 and 9. It comprises a sheet metal body similar to that illustrated in FIG. 6 and designated with reference numerals 34 and 36. It also comprises three hook-like elements 38 and prongs 62 which are adapted to pass through bores 64 customarily provided in such end brackets. In this manner, the prongs 62 can be passed through the bores 64 and the entire clip 60 is slipped downwardly so that the clip comes to a firm rest position by the prongs 62 engaging the inside of bracket 14. A slat 30 is shown in dot dash lines as being attached to clip 60, in FIG. 8.

Figure 10:
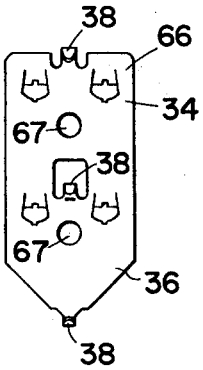
FIGS. 10, 11 and 12 are front, side and top views, respectively, of a further embodiment of a holder or clip for attaching a valance to the side of a venetian blind head.
Figure 11:
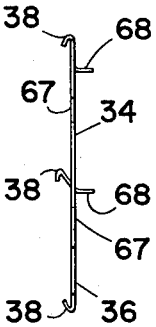
Figure 12:
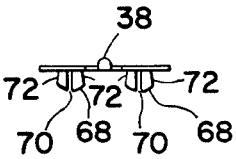
Figure 15:
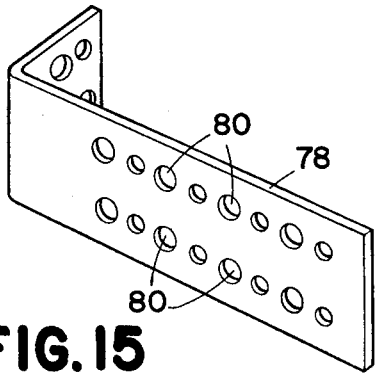
FIG. 15 shows a bracket for connection to a wall and to which a holder of FIGS. 11 and 12 can be attached.

A very advantageous embodiment of a clip for attaching a valance to the end bracket of a venetian blind head is illustrated in FIGS. 10 to 12. This clip designated with the reference numeral 66 again comprises a sheet metal body 34 with an end section 36 and three hook-like elements 38. It also comprises four tabs 68 struck from the body 34 and extending rearwardly therefrom. Each tab 68 is provided with a slot 70, enabling it to be compressed as it is pushed into an opening such as bore 64 shown in FIG. 8. Since the tabs are resilient they hold securely in brackets and because they are tapered and undercut at 72 they can be used with brackets of different thicknesses. The tabs have sufficient holding power to resist the tension of a valance which has been curved around the brackets. Even after having been removed several times, the tabs continue to hold well. However, if they should lose their grip they can very easily be made effective again by spreading the prongs with a screwdriver or knife blade.

Figure 13:
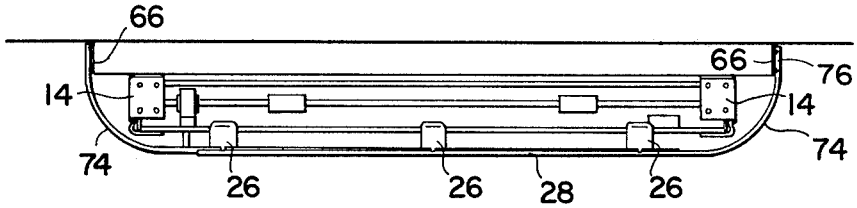
FIGS. 13 and 14 are top views of two embodiments of a venetian blind in which the slats are not directly attached to the sides of the venetian blind head, but instead are somewhat spaced therefrom and attached to a wall or window frame.

The design of FIG. 13 differs from that of FIG. 1 in that the valance 74 is curved rather than bent at right angles, as is the valance 30 illustrated in FIGS. 1 to 3. Moreover, the bent valance 74 is connected to a window jamb 76 by means of a clip such as clip 66 previously described, which is screwed directly to the jamb 76 by passing screws through holes 67 of clip 66, the hooks or prongs having been flatened by hammerblows or eliminated.

Figure 14:
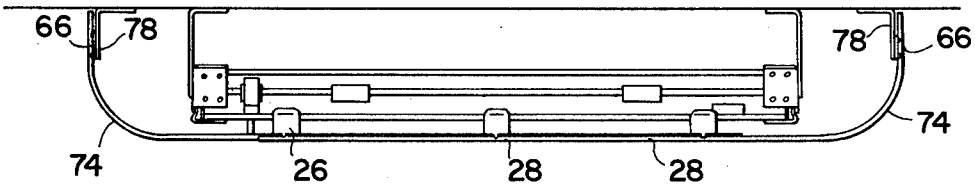

The arrangement according to FIG. 14 is similar to that of FIG. 13. However, the curved valance 74 is connected to a bracket 78 attached to a wall. A bracket, such as bracket 66, is interposed between the valance 74 and bracket 78, by passing the tabs 68 through holes 80 of bracket 78.

It is to be understood that the invention is not limited to the embodiments shown and described herein, but only by the scope of the appended claims.

I claim:

1. An article of manufacture for use in connection with a venetian blind, comprising: a body of substantially flat sheet metal having means for supporting at least one valance in a substantially horizontal position, said supporting means comprising three spaced prongs protruding from said body and substantially in vertical alignment with each other, said body also having means for connecting said body to a support, said body comprising a first body portion having a top, said supporting means being connected to said first body portion, said body comprising a second body portion spaced from said first body portion in a direction substantially perpendicular to said first body portion and extending substantially parallel to said first body portion, said second body portion having a top and a bottom and integrally formed thereon at its top means for clamping said body to a venetian blind head, and means for positively holding said first body portion in a substantially vertical plane when connected to said venetian blind head, said holding means forming a third body portion connecting the bottom of said second body portion to the top of said first body portion.

* * * * *